US006516811B1

(12) United States Patent
Focke et al.

(10) Patent No.: US 6,516,811 B1
(45) Date of Patent: Feb. 11, 2003

(54) PROCESS FOR CONTROLLING A PRODUCTION AND PACKAGING SYSTEM

(75) Inventors: Heinz Focke, Verden (DE); Henry Buse, Visselhövede (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/534,645

(22) Filed: Mar. 23, 2000

(30) Foreign Application Priority Data

Mar. 29, 1999 (DE) ..... 199 14 297

(51) Int. Cl.[7] ..... B65B 19/28; A24C 5/35

(52) U.S. Cl. ..... 131/283; 131/58; 53/52; 53/396; 53/444

(58) Field of Search ..... 131/283, 58; 53/444, 53/396, 52

(56) References Cited

U.S. PATENT DOCUMENTS

| | | | | |
|---|---|---|---|---|
| 3,690,327 A | | 9/1972 | Heitman | 131/21 R |
| 3,889,240 A | | 6/1975 | Buchegger | |
| 4,030,511 A | * | 6/1977 | Wahle | 131/21 R |
| 4,599,699 A | | 7/1986 | Stewart-Cox et al. | 364/552 |
| 4,962,840 A | * | 10/1990 | Miura et al. | 199/347.1 |

FOREIGN PATENT DOCUMENTS

| | | |
|---|---|---|
| DE | 3519580 | 5/1987 |
| DE | 3319248 | 12/1992 |
| DE | 4404929 | 8/1995 |
| DE | 19652210 | 6/1998 |

OTHER PUBLICATIONS

EPO Search Report EP 00 10 5261 Apr. 09, 2002.

* cited by examiner

*Primary Examiner*—Christopher A. Fiorilla
(74) *Attorney, Agent, or Firm*—Abelman, Frayne & Schwab

(57) ABSTRACT

The invention proposes measures for controlling a production and packaging system for cigarettes such that a certain number of cigarettes (batch) of a certain brand or design are produced and the system is then switched off. This is based on a quantity which is to be produced, that is to say a specified quantity. Taking account of the actually occurring defective production at individual production units and subassemblies, the overall production requirement is determined and produced accordingly and packaging material is made available to the individual production units.

17 Claims, 7 Drawing Sheets

PROCESS FOR CONTROLLING A PRODUCTION AND PACKAGING SYSTEM

DESCRIPTION

Figure 1:
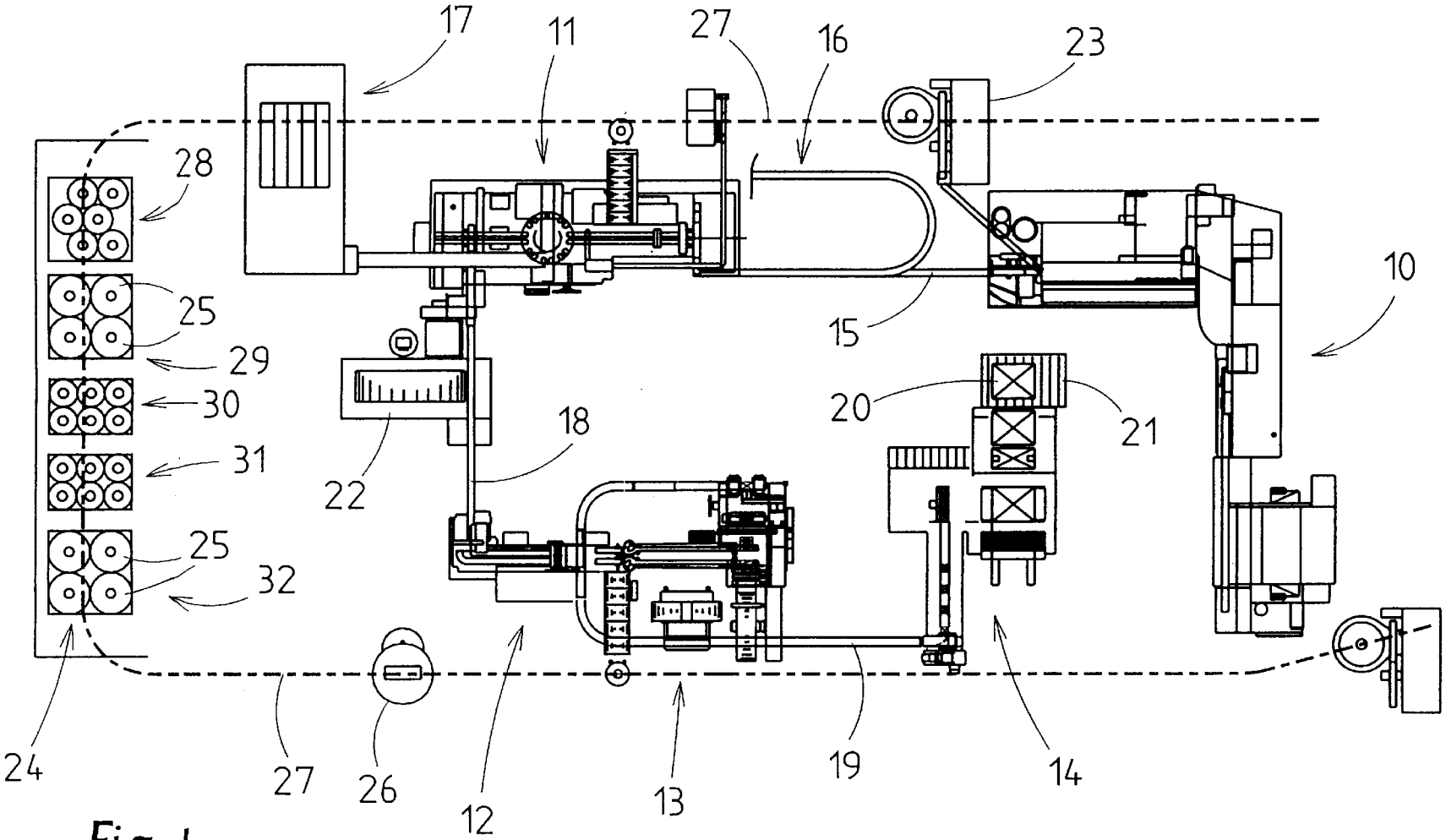

The invention relates to a process for controlling a production and packaging system for cigarettes, or similar products, comprising production units such as a cigarette (cigarette) manufacturing machine (maker), packaging machine (packer), film wrapping machine (when appropriate), bundle packaging machine (multipacker) (when appropriate), and carton packer (cartoner) (when appropriate) for the production of products—cigarettes—in a certain, limited quantity—desired quantity—and packaging them ready for shipping. The invention also relates to an apparatus for executing this process.

The production of cigarettes (or cigarillos) increasingly requires quick, cost-effective adaptation to different products. These differences may relate to the quality of the cigarettes, or different brands, designs etc. It is often the case that only certain quantities of a type or brand or design are to be produced.

Up until now, the production and packaging system has only been adapted approximately to the number of (cigarette) packs which are to be produced, with a safe margin of excess production. It is often the case that this excess quantity cannot be sold and must ultimately be destroyed.

The object of the invention is to control the, in particular, entire production and packaging system for cigarettes such that limited quantities—desired quantities—can be produced without the production being associated with overly excessive production.

In order to achieve this object, a first process according to the invention consists of the following features:

a) the quantity of completely or partially finished products—e.g. cigarettes and/or cigarette packs—present in the production process or packaging process is measured, along with the products located in stores, on a permanent or cyclical basis and compared with the desired quantity to be produced, on one hand, and with the actual quantity already produced.

b) when a critical actual quantity is reached, which together with the products presently in the production or packaging process results in the desired quantity to be produced, the successive production units are run down one after the other, emptied and finally switched off, with any stores also being emptied in such a way that the desired quantity has been produced by the time the production and packaging system comes to a standstill.

Monitoring of the stores for cigarettes and cigarette packs as well as of the other production units of the line is carried out by known elements, such as sensors, tactile members, counters etc., so that the current production level can be determined at practically any time, thus making it then possible to take further measures.

Alternatively, the problem can be solved by the invention in that it is possible to have the material required for the desired quantity, in particular packaging material, made available on the basis of the desired quantity to be produced and by taking into account the productive capacity of the individual production units, the rate of rejects known from experience, as well as by accounting for current faulty production in each production unit.

The production sequence of the entire production and packaging system is evaluated by a common central computer and displayed on a screen monitor connected thereto.

A further special feature of the process according to the invention is that before the desired quantity of products—cigarettes/cigarette packs—is reached, the material present at each production unit, in particular packaging material, is checked with respect to its subsequent usability for the next type of product and displayed on a screen.

According to the invention, the desired quantity to be produced can be based on a product-specific setting, or, alternatively, on the present stock of a certain material, such as revenue labels for cigarette packs. The desired quantity can then be equal to the number of revenue labels on hand.

Figure 2:
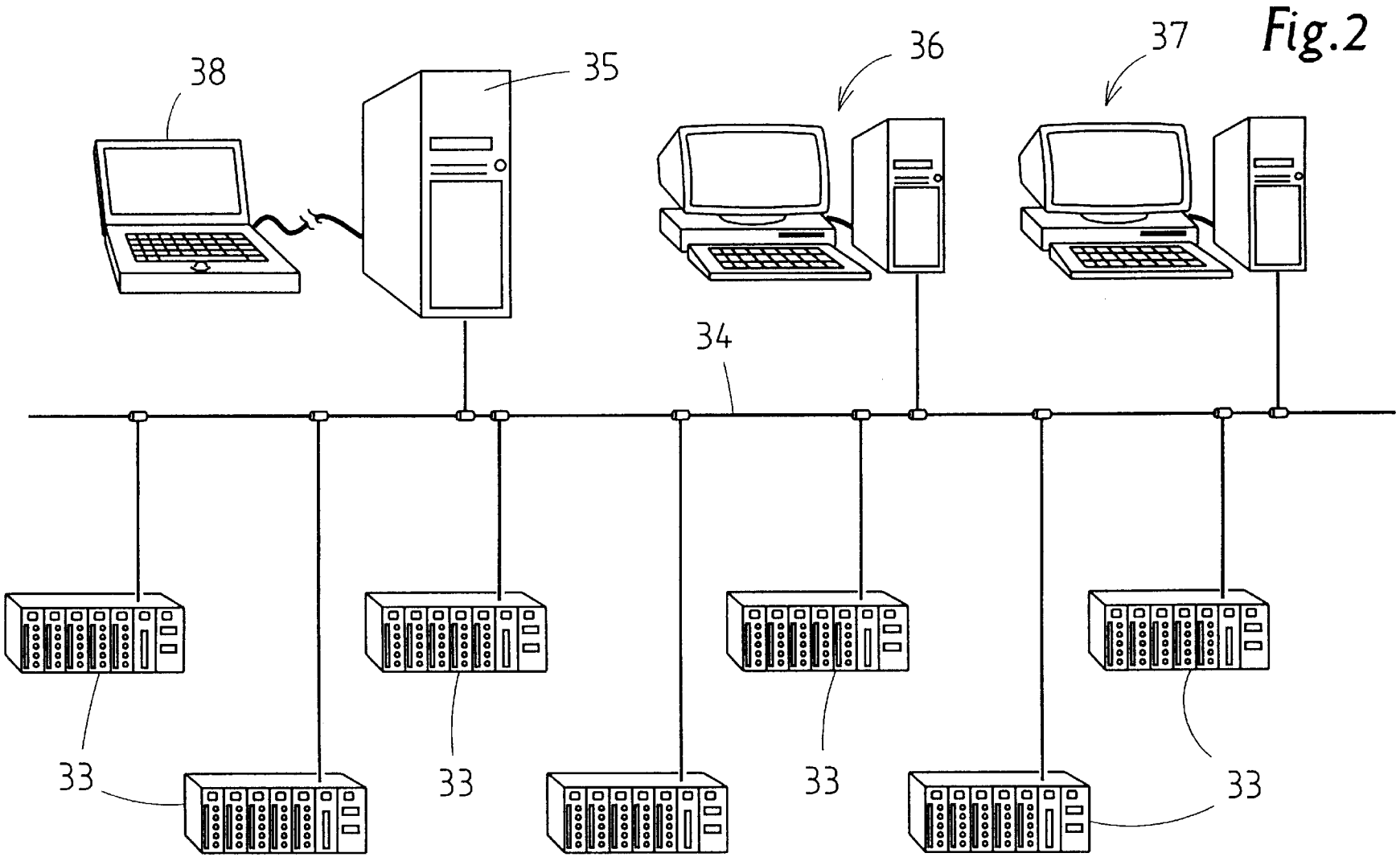
Figure 3:
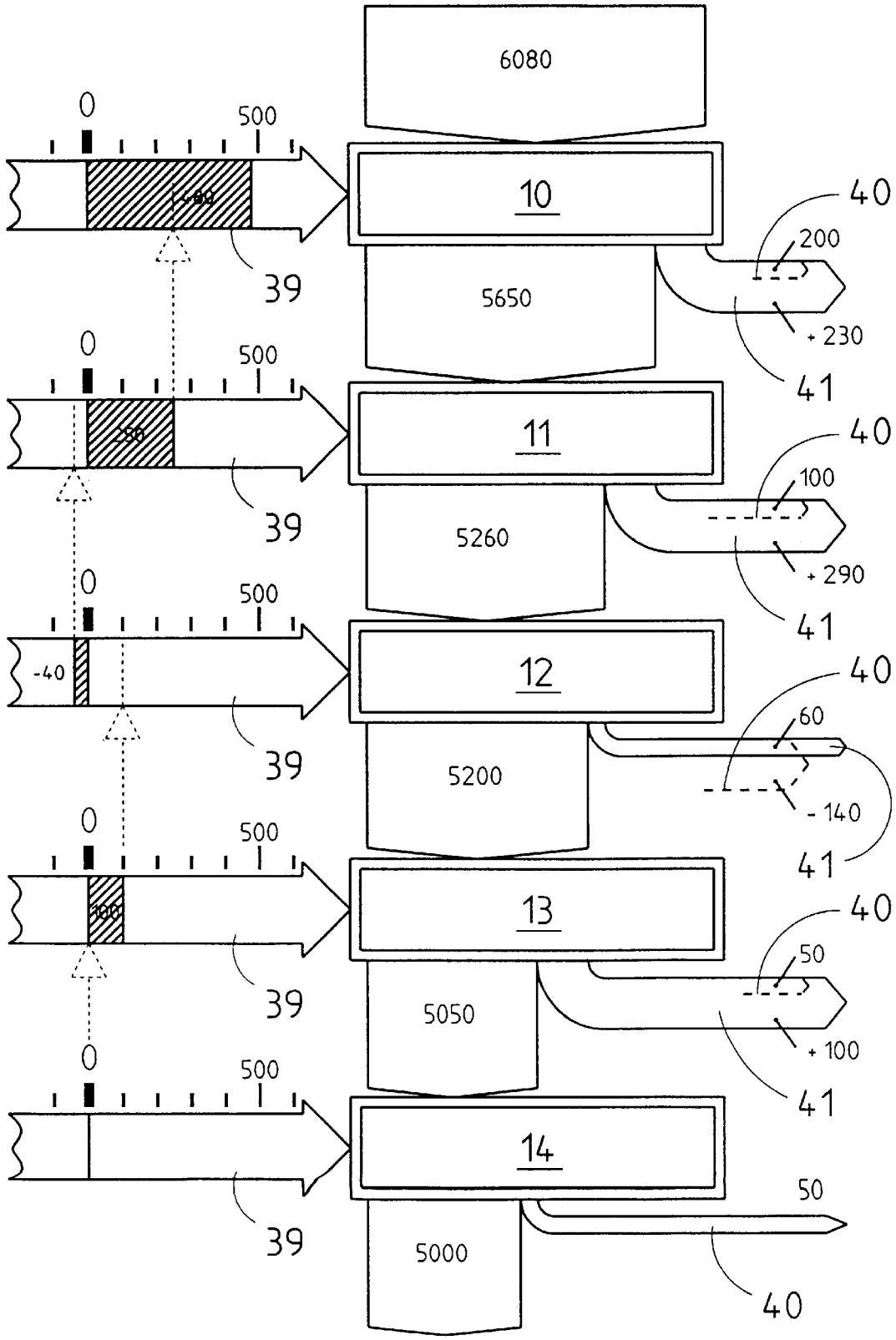
Figure 4:
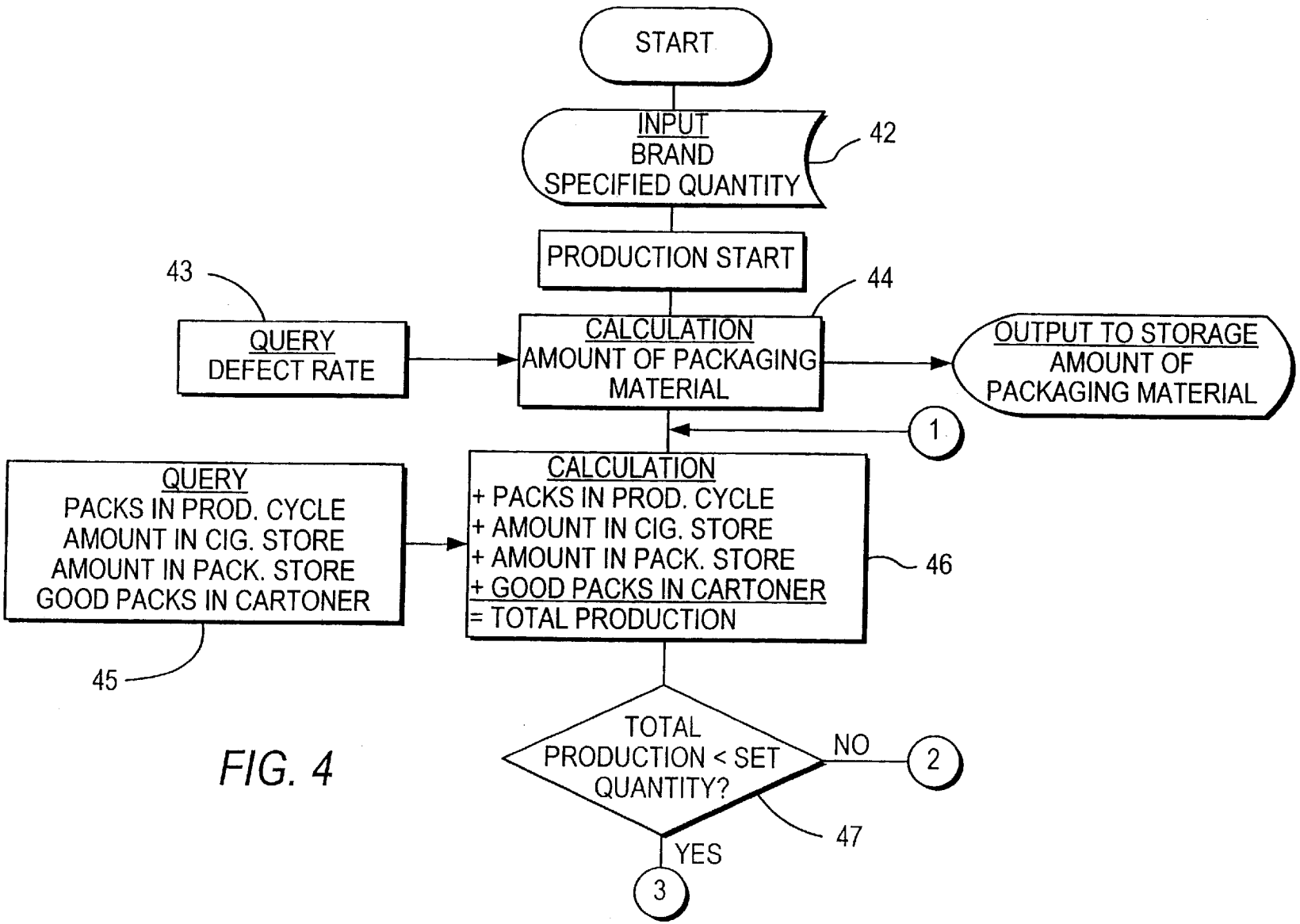
Figure 5:
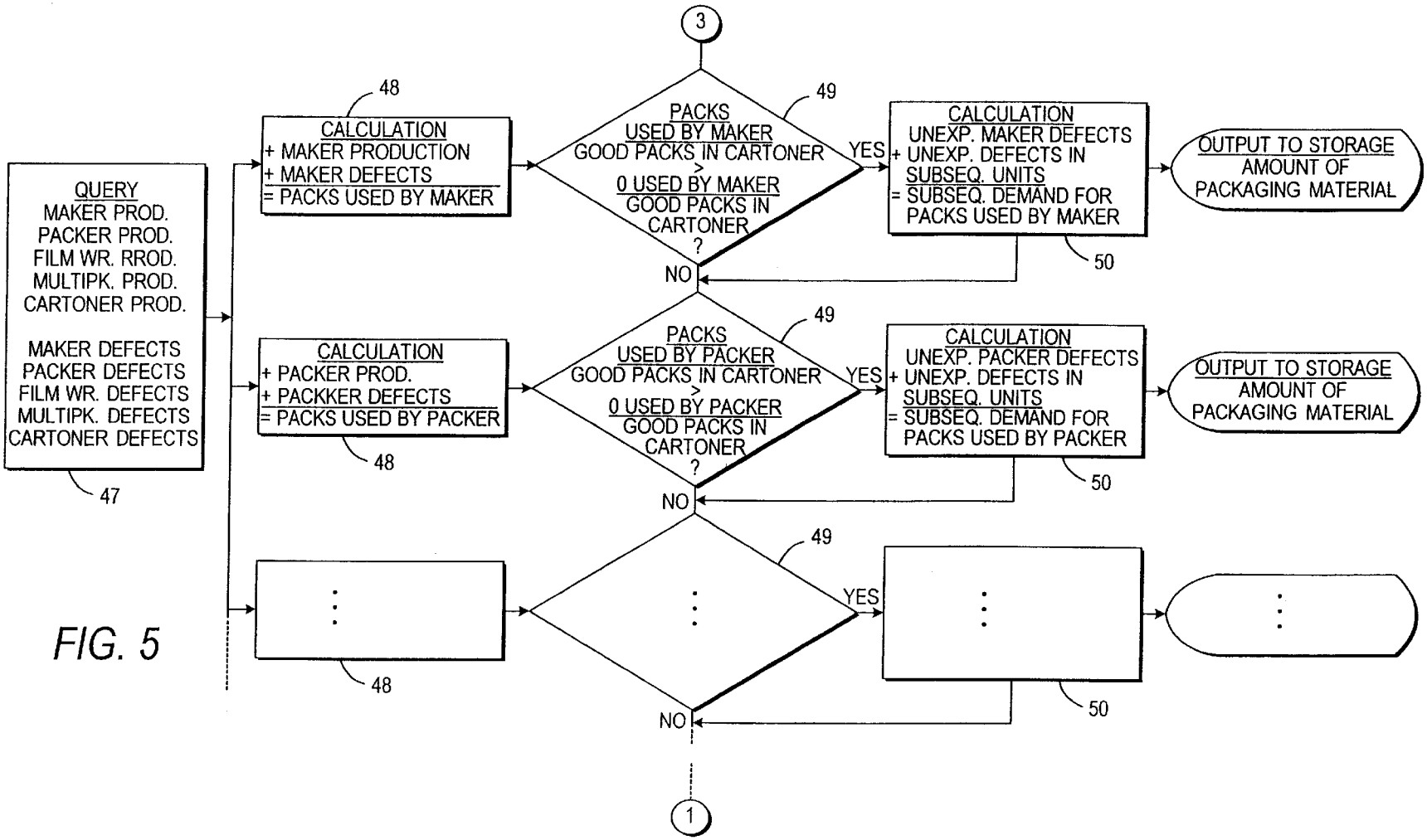
Figure 6:
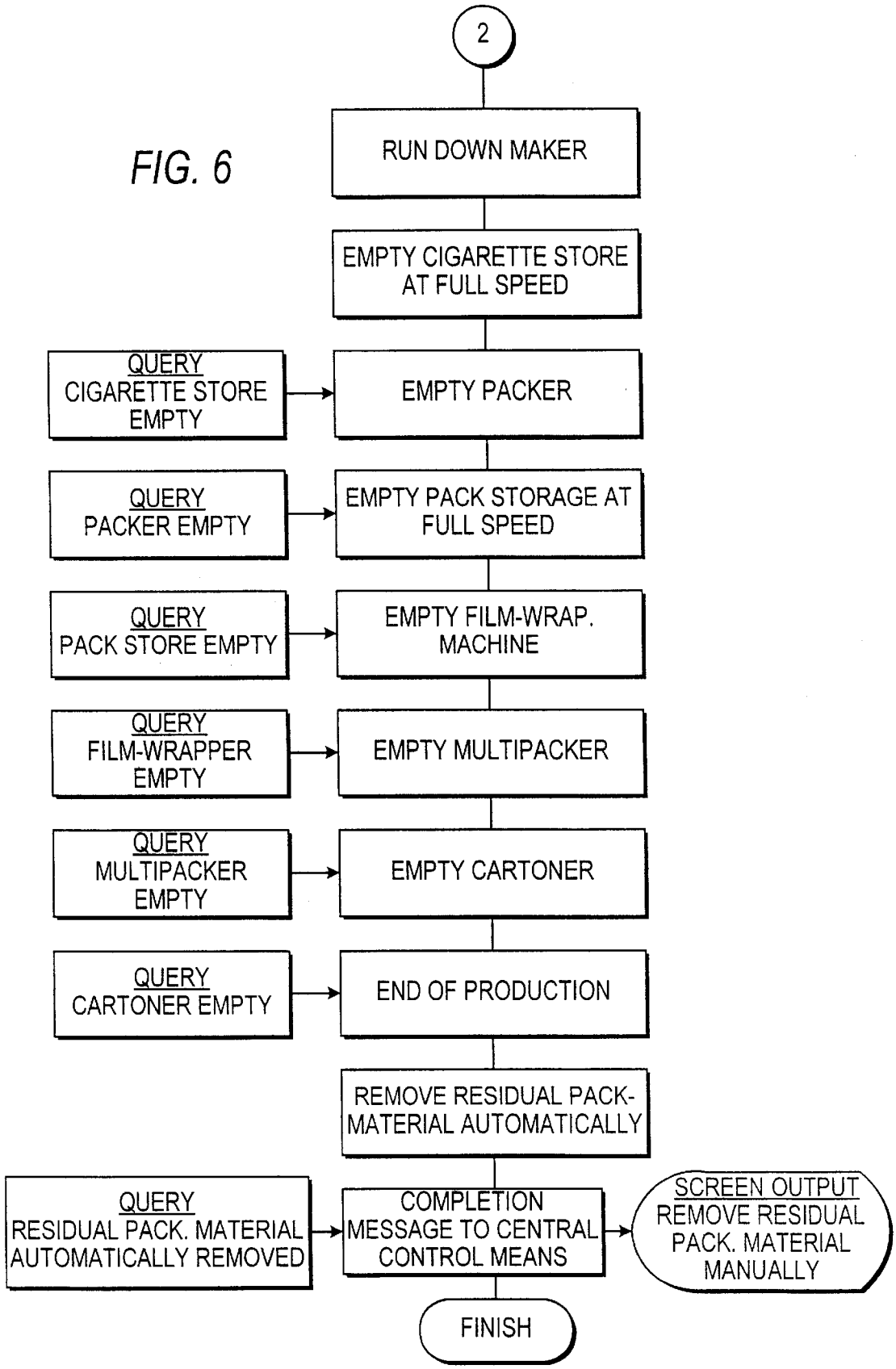

Further special features of the invention are explained in more detail hereinbelow with reference to the drawings, in which:

FIG. 1 shows a schematic plan view of a production and packaging system for cigarettes, FIG. 2 shows a schematic illustration of a control apparatus for a system according to FIG. 1, FIG. 3 shows a flow diagram concerning the quantity control of the system, FIG. 4 shows a graphic chart concerning the functional sequence during production and packaging of the cigarettes, FIG. 5 shows a further diagram concerning the determination of the amount of material required, and FIG. 6 shows a diagram concerning the sequence during termination of the production of a batch.

Figure 7:
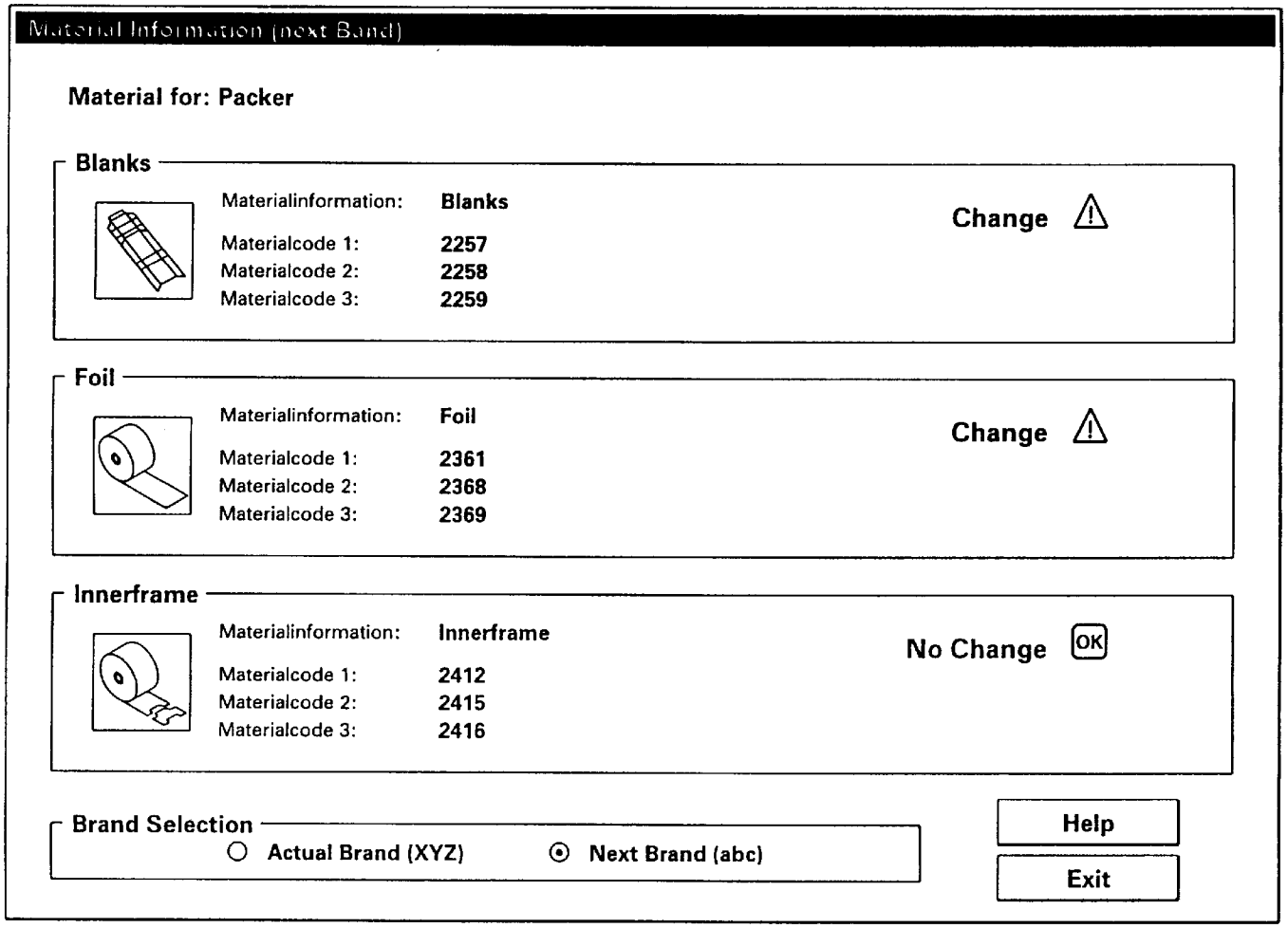

FIG. 7 shows a sample screen display.

The exemplary embodiment illustrated in the drawings relates to a production system for cigarettes, that is to say a so-called line. The latter consists of production units, namely for example, a cigarette-production machine, that is to say a maker 10, a packaging machine adjoining the latter, that is to say a packer 11, a following film-wrapping machine 12, a packaging machine for producing multipacks from a plurality of cigarette packs, that is to say a multipacker 13, and a cartoner 14 which packs the multipacks, that is to say cigarette multipacks, in a shipping box.

The cigarettes produced by the maker 10 are sent to the packer 11 by a cigarette conveyor 15 with a cigarette store 16. Said packer may be, for example, a hinge-lid packer, that is to say a packaging machine for producing hinge-lid boxes. The packer 11 is assigned a blank store 17, that is to say an apparatus for receiving a relatively large supply of prefabricated blanks for the hinge-lid box. The blank store 17 also has conveying elements for feeding blank stacks to the packer 11.

The (cigarette) packs produced by the packer 11 are fed to the film-wrapping machine 12 via a pack conveyor 18. Said film-wrapping machine has the task of wrapping the cigarette packs in an outer film or plastic blank. The finished cigarette packs are used to form pack groups which are provided, in the region of the multipacker 13, with a multipack wrapper and thus produce a cigarette multipack comprising usually ten cigarette packs. These cigarette multipacks are fed to the cartoner 14 by a multipack conveyor 19. Said cartoner transfers finished shipping boxes 20, with a plurality of cigarette multipacks, to a removal conveyor 21. Located in the region of the pack conveyor 18, between the packer 11 and the film-wrapping machine 12, is a pack store 22 for receiving a relatively large number of cigarette packs (without an outer wrapper).

The production units described have to be supplied with material. The maker 10 is to be fed sufficient quantities of tobacco and also cigarette paper in the form of wound webs, namely reels. Furthermore, the maker 10 is likewise to be fed filter attachment paper wound in the form of reels, in order that the finished cigarettes may be supplied with the corresponding material in the region of a filter attachment machine 23. Packaging material likewise in wound webs, that is to say in the form of reels, is also to be delivered to the other production units. This applies to the production of a collar which is conventional in cigarette packs of the hinge-lid-box type, and also to an inner wrapper, a so-called inner liner of the cigarette group, and to the outer wrapper made of film or cellophane. Provided for this purpose is a central storage means 24 in which the reels 25 of the different materials are stored, for example, on pallets. A suitable conveying arrangement, for example a common material conveyor 26, can be displaced along a conveying path 27 between the storage means 24 and the individual production units for the delivery of the reel material as required.

In the example shown, the storage means 24 may be constructed such that the filter attachment paper 28, collar material 29, inner-liner material 30, film material 31 and cigarette paper 32 are positioned in the region of the conveying path 27 in order to be received by the material conveyor 26, to be precise in each case in favorable positions relative to the associated production unit.

The sequence of the cigarette production up to the production of the finished shipping box 20 filled with cigarette multipacks is monitored, and registered, continuously or from time to time. For this purpose, according to FIG. 2, a control subassembly 33 of each production unit or machine unit is connected to a central line 34. Connected to the central line 34, in turn, is a central computer 35. Computers in the region of the (material-) storage means 24 and in the region of the shipping point, that is to say a storage-means PC 36 and a shipping-point PC 37 are also connected. Said shipping-point PC is located in the region of the cartoner 14 and/or of the removal conveyor 21. The central computer 35 can be fed data, in the present case by the laptop 38. The control subassemblies 33 are assigned to the maker 10, the filter attachment machine 23, the packer 11, the pack store 22, the multipacker 13 and the cartoner 14.

According to a first embodiment, production control relating to a certain production quantity is carried out such that a small safety margin, for example between 5% and 10%, is added on to the required production quantity, and that the resulting specified quantity—desired quantity—serves as an input variable. The actual production, that is to say the total production, is greater than the desired quantity, to be precise by taking into account the production of rejects or defective production at each production unit. The control means illustrated as an example takes into account, on the one hand, the expected defective production and, on the other hand, unexpected defective production. This gives the actual defective production. The expected defective production is obtained from the data on the individual production units and subassemblies, which are obtained and stored on account of the on-going operations evaluation. The unexpected defective production is determined by monitoring and query of production data from the individual production units and subassemblies during production. The production requirement of the system is determined constantly from the two types of data, account being taken of the specified quantity, that is to say such that, upon completion of production and packaging, the desired quantity has been reached.

The number of cigarettes which are to be produced is obtained from the desired quantity and the actual defective production of the line as a whole. The cigarette production thus has to be adapted, that is to say increased or reduced, in accordance with the data, which may change during the production and packaging process.

By taking account of said data, namely of the desired quantity and the expected, or previously known, defective production, the necessary material is made available to each production unit at the beginning of production. The unexpected defective production results in a change in the supply of material, in particular in the subsequent demand for, and delivery of, material for individual production units.

As explained by means of the flow diagram in FIG. 3, it is assumed that the specified quantity—desired quantity—is 5000 units, i.e. 5000 cigarettes or packs, for example. Based on queries in the region of the production units, the number of additional units required for production is determined in each case. The individual production units are illustrated schematically as rectangles. In each case one bar-like symbol for the subsequent demand 39 for material is illustrated on the left-hand side of the individual production units 10, 11, 12, 13, 14. Illustrated symbolically by way of horizontal stripes on the opposite side is the defective production, to be precise, in solid lines, the actual defective production, which is made up of the expected defective production 40 (dashed lines) and the unexpected defective production 41.

It is assumed that the cartoner 14, as the final machine in the line, has delivered an actual (overall) defective production quantity of 50 units, and that this corresponds to the expected defective production 40, that is to say unexpected defective production has not arisen. An (expected) requirement for an additional 50 units is determined as a result of the operation of the cartoner. The preceding multipacker 13 has to deliver a useable production quantity of 5050 units.

An expected defective production of 50 units and, in addition, an unexpected defective production of 100 units is assumed for the multipacker 13. This means, on the one hand, that the preceding production unit, that is to say the film-wrapping machine 12, has to deliver a useable quantity of 5,200 units. Furthermore, a subsequent demand 39 for packaging material is necessary, to be precise for the unexpected defective production of 100 units.

In this example, the film-wrapping machine 12 has an overall defective production of 60 units, as compared with an assumed defective production 40 of 140 units. Since the preceding machine, namely the packer 11, has to meet a requirement based on the actual defective production, the packer 11 has to deliver a quantity of 5260 units.

It also has to be taken into account for the packer 11 that there is a predetermined, assumed defective production of 100 units. Furthermore, an unexpected, that is to say additional, defective production 41 of 290 units has to be taken into account. This means that, on account of the output of the packer 11, the maker 10 must additionally deliver cigarettes for 390 units, that is to say a total of 5,650 units.

Other considerations come to bear for the subsequent delivery of packaging material to the packer 11 (during the production process). The subsequent demand 39 for the packer 11 is in fact determined by the unexpected defective production 41, that is to say it has to meet a requirement of 290 units. Since, however, the following production unit, that is to say the film-wrapping machine 12, has a material credit of 40 units, the packer 11 needs only be subsequently supplied with material for 250 units.

As a result of the following production units, the maker 10 has to meet a production requirement of 5,650 units. It is assumed that an expected defective production 40 of 200 units is given. Added to this, however, is an unexpected defective production 41 of 230 units. This means that there has to be an overall cigarette production of 6080 units in order to allow for the output of the maker 10 and all the following production units, so that the specified quantity of 5000 is reached at the end.

On account of the given requirements of the following production units, material, that is to say tobacco and cigarette paper and also filter paper for 480 units has to be subsequently delivered to the maker 10 during the production process.

The block diagrams according to FIGS. 4, 5 and 6 show the sequences, during production, for determining the requirements and for ending the production process.

FIG. 4 shows an overview of the production sequence, the functions and/or measures being illustrated in individual zones.

In accordance with zone 42, at the beginning of the production of a batch, the central computer 35 has input into it the brand which is to be produced and the specified quantity, that is to say the required amount which is to be produced, including a small safety margin. The production program then begins.

For the production, the (initial) quantity of packaging material and other material has to be supplied to each production unit. For this purpose, in accordance with zone 43, the stored, average and/or expected defective production for each production unit or each subassembly is retrieved from the central computer. In conjunction with the specified quantity, it is possible to calculate the material quantity, in particular the quantity of packaging material, in accordance with zone 44. Corresponding information is transmitted to the storage-means PC 36 and the material is accordingly made available to the individual production units.

This calculation cycle is repeated a number of times or continuously during the production of the batch, to be precise for all production units of this line. The established changes in relation to the specified values and assumptions are taken into account here in each case. This requires the production units to be monitored by sensors and other monitoring elements with respect to the production process and above all to completely or partially finished products located on the line. Provided in particular in the production units and in the stores are (known) sensors and sensing elements which sense the respective filling level and send the corresponding data to the central computer 35.

In accordance with zone 45, and for the purpose of registering the wholly or partially produced quantities, following each calculation cycle the current result is determined again by query and calculation. First of all the number of packs in a production process is established by query. Furthermore, the quantity of cigarettes stored in the cigarette store 16 and the quantity of packs in the pack store 22 is detected. Finally the packs which have left the cartoner 14 and are introduced as acceptable packs into the shipping box 20 are also registered.

These query data are used, in accordance with zone 46, to carry out a calculation, to be precise the current total production is determined from the query in accordance with zone 45. In accordance with zone 47, the total production calculated is compared with the desired quantity. If the total production has not (yet) reached the desired quantity, the requirement-related calculation for the individual production units is repeated, to be precise in accordance with the process illustrated in FIG. 5. In contrast, achieving or exceeding the specified quantity initiates the operation of switching off the production line in accordance with the steps illustrated in FIG. 6.

FIG. 5 gives the calculation sequence for determining the amount of material required, in particular the amount of packaging material required for the individual production units.

In accordance with zone 47, machine-specific data are queried, that is to say the production output of the maker 10, packer 11, film-wrapping machine 12, multipacker 13 and cartoner 14. The defective production of the aforementioned production units is also established, to be precise the actual defective production is established from the known (assumed) defective production and the unexpected defective production. These data in accordance with zone 47 are used, in accordance with zone 48, to calculate the amount of material or packaging material used for the individual production units. In accordance with zone 49, a comparison calculation is then carried out, to be precise the actual amount of material or packaging material used in relation to the acceptable packs in the region of the cartoner 14 is compared with the average amount of material used by the relevant production unit (with the expected defective production) likewise in relation to the acceptable packs in the region of the cartoner 14. If the first comparison number is greater than the second, in accordance with zone 50 a further calculation is carried out, that is to say for the subsequent demand for packaging material or other material for the relevant production unit. For this purpose, the defective production quantities of the relevant production unit, for example of the maker 10 and of the following production units 11, 12, 13, 14, are added and the subsequent demand for material for the relevant production unit is determined from this. Corresponding information is given to the storage means. This calculation is carried out successively for all production units on the line.

If, on account of the queries and calculations illustrated in conjunction with FIG. 4, the total production is equal to or greater than the specified quantity, this has the effect of initiating the switch-off operation according to FIG. 6.

First of all the maker 10 is run down. This means that the feed of materials—tobacco, cigarette paper and filter paper—is interrupted and the maker 10 is emptied as far as production is concerned and finally switched off. The cigarette store 16, which is arranged downstream of the maker, is emptied while maintaining the operating speed of the following production unit. The filling level of the cigarette store 16 is queried continuously. If the cigarette store is empty, the emptying operating state is initiated for the following packer 11. Once corresponding query has found that the packer 11 has emptied, this production unit is switched off.

The pack store 22 is emptied at full operating speed. The filling level is monitored in this case too. Once the pack store 22 has emptied, the emptying operating state is initiated for the following film-wrapping machine 12.

The filling level of the film-wrapping machine 12 is then queried. When this production unit is empty, it is switched off. At the same time, the multipacker 13 is changed over to the emptying operating state. If the query finds that the cartoner 14 has been emptied, production is at an end. All production units are switched off. Residues of packaging material are removed automatically. This is checked by query. A completion message is sent to the central computer 35. This indicates the end of production.

The preceding description of the monitoring of the entire production and packaging system with respect to already finished or semi-finished products makes it possible to realize a different, advantageous control of the production quantity or of a desired quantity to be produced. Here it is assumed that the individual production units of the line are provided with sufficient material, especially packaging material, or that this is supplied when needed. Instead of keeping continuous account of previously known, expected or unexpected defective production, an already finished quantity of products (cigarette packs/cigarettes), i.e. an actual quantity, is compared continuously or by cyclical query—for example at intervals of 10 s.—and by making calculations accounting for the material present in the production and packaging system or by accounting for completely or partially finished products. This result is compared with the desired quantity. When the actual produced quantity together with the products present in the production and packaging system reaches the desired quantity, the process for turning off the production and packaging system is initiated: first by running down the system and then by turning off in succession the maker and all of the following production units.

The specified desired quantity can be determined in a number of ways, in particular also by the required use of certain materials. In particular it may be necessary to use up all pack blanks of a particular design and/or revenue labels which are on hand so that the desired quantity of items to be produced is thus set accordingly.

Finally, a special feature ensues from FIG. 7, namely from the representation of the display screen connected to the central computer 35, for example, that of the laptop 38. The display provides information on the present stock and type of material, or its possible uses, of a production unit, specifically of the packer 11. The information relates to the upcoming change-over in the type of product, for example a change of brands. The packaging materials processed in the packer 11 are specified, namely blanks, foil web (for the inner wrapper of the cigarette group) and material webs for the production of collar blanks. The screen display shows that the products "blanks" and "inner wrapper" are not appropriate for the next brand. When the production and packaging system is shut down, the two packaging materials are to be exchanged accordingly. On the other hand, the material for the collar can also be used for the next brand of packs.

The material is always supplied to the production units in complete units which are kept as small as possible, for example on pallets bearing a pre-specified amount of the packaging material.

What is claimed is:

1. A method for controlling a cigarette production and packaging system comprising a plurality of production units for making intermediate cigarette products from corresponding supply materials, said production units including a cigarette maker for producing individual cigarettes, said supply material for said maker including tobacco and cigarette paper, and a cigarette packaging machine for producing cigarette packs incorporating said individual cigarettes, said supply material for said packaging machine including blanks, wherein said method comprises the steps of:

determining the requirements of said maker and said packaging machine for the quantities of corresponding supply material necessary for each to produce a desired quantity of cigarette packs, wherein said determining step takes into account possible defective production at each of said maker and packaging machine;

supplying quantities of corresponding supply material to said maker and said packaging machine based on the requirements determined in said determining step; and setting each of said maker and said packing machine to produce the desired quantities of cigarettes and packs taking into account possible defective production of each of said maker and said packing machine and then turning off each in turn after it produces the desired quantities of cigarettes and packs, respectively.

2. A method as in claim 1, wherein the desired quantity of packs is determined on the basis of the quantity of blanks available.

3. A method as in claim 1, wherein said maker and packaging machine are supplied with tobacco and cigarette paper and blanks, respectively, based on a known average output of each of said maker and said packaging machine, including the expected defective production thereof.

4. A method as in claim 3, wherein actual defective production for each of said maker and said packaging machine is determined on either a continuous or cyclical basis during operation thereof and compared with the expected defective production, such that during operation of said system changes in total production are made on the basis of any differences between actual and expected defective production.

5. A method as in claim 1, wherein the actual quantity of cigarettes to be made by said maker is determined taking into account the expected defective production of said packaging machine, such that during operation of said system changes in total production are made on the basis of any differences between the actual and expected defective production of said packaging machine.

6. A method as in claim 1, wherein said system further comprises the following production units:

a film wrapping machine for wrapping said cigarette packs in a packing film, said supply material for said film wrapping machine including said packing film;

a multipacker for packaging a predetermined quantity of said film-wrapped cigarette packs in a carton, said supply material for said multipacker including multipack wrappers; and a carton packer for packing a predetermined quantity of said cartons into a shipping box, said supply material for said carton packer including said shipping boxes.

7. A method as in claim 6, wherein during operation of said system the desired quantity to be produced by each said production unit is determined multiple times based on actual production thereof and compared with the desired quantity, said determination being repeated as long as the total quantity produced is less than the desired quantity.

8. A method as in claim 7, wherein operation of each said production unit is terminated when its total production is greater than or equal to the desired quantity to be produced thereby.

9. A method as in claim 6, wherein said method further comprises the step of terminating production by running down each successive said production units and a store for corresponding supply material therefor one after the other and switching each of said production units them off when it is empty, the status of each said production unit being determined by querying each said production unit in turn starting with said maker.

10. A method as in claim 6, wherein changing said system over from producing one cigarette brand to another comprises the following steps:

checking each said production unit to determine if the product it produces can be used to produce the different brand; and displaying the result of said checking step on a visible display device.

11. A method as in claim 6, wherein measuring and control elements of each said production unit are connected to a central computer with a visible display device.

12. A method as in claim 11, wherein each said intermediate production unit includes a control subassembly connected to said central computer by an control bus.

13. A method for controlling a production and packaging system, the system comprising a plurality of production units, each of which produces a quantity of a corresponding intermediate product and provides it to another said production unit, said production units cooperating to produce a desired quantity of finished products packaged for shipping, the method comprising the steps of:

measuring the quantity of intermediate products produced by each said production unit and supplies for producing same in stores associated with said system, said measuring step including comparing on either a continuous or cyclical basis a desired quantity of corresponding intermediate products to be produced by each said production unit with a quantity of the corresponding intermediate products actually produced by said production unit; and terminating production when the total quantity of finished products packaged for shipping and intermediate products actually produced by said production units totals the desired quantity of finished products packaged for shipping, wherein successive said production units are run down one after the other and switched off when empty of the corresponding intermediate product, thereby terminating production such in such a way that the desired quantity of finished products packaged for shipping has been produced by the time all of the production units are switched off.

14. A method as in claim 13, wherein supplies are periodically supplied in predetermined quantities to said production units from said stores.

15. A method as in claim 13, wherein changing said system over from producing one finished product to a different finished product comprises the steps of:

checking each said intermediate product being produced to determine if it can be used to produce said different finished product; and displaying the result of said checking step on a visible display device.

16. A method as in claim 13, wherein measuring and control elements of each said production unit are connected to a central computer with a visible display device.

17. A method as in claim 16, wherein each said intermediate production unit includes a control subassembly connected to said central computer by a control bus.

* * * * *